United States Patent [19]

Lane

[11] Patent Number: 4,778,217

[45] Date of Patent: Oct. 18, 1988

[54] ORTHOPEDIC CHAIR

[76] Inventor: Bruce E. Lane, 3507 W. Voltaire Ave., Phoenix, Ariz. 85029

[21] Appl. No.: 15,306

[22] Filed: Feb. 17, 1987

[51] Int. Cl.[4] ..... A47C 1/00

[52] U.S. Cl. ..... 297/334; 297/335; 297/DIG. 10

[58] Field of Search ..... 297/6, 326, 331, 334, 297/335, 337, DIG. 10; 248/371

[56] References Cited

U.S. PATENT DOCUMENTS 299,875 6/1884 Stone ..... 297/331 X
430,433 6/1890 Peregrine ..... 297/331
4,632,455 12/1986 Schiller et al. ..... 297/DIG. 10 X
4,637,654 1/1987 Boardman ..... 297/DIG. 10 X

FOREIGN PATENT DOCUMENTS 465175 5/1937 United Kingdom ..... 297/334

*Primary Examiner*—Kenneth J. Dorner
*Assistant Examiner*—Peter R. Brown
*Attorney, Agent, or Firm*—Nissle & Leeds

[57] ABSTRACT

An improved orthopedic chair. The chair utilizes the force of gravity and weight of an individual balanced about a fulcrum to control the rate of descent of an individual from a standing to a seated position.

2 Claims, 2 Drawing Sheets

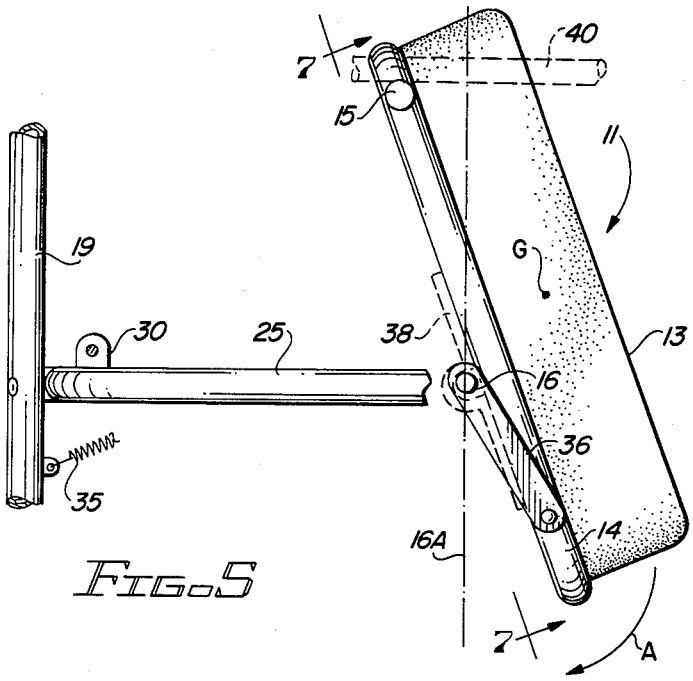
FIG. 5
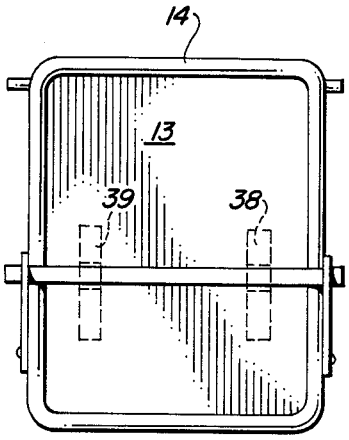
FIG. 7
FIG. 6
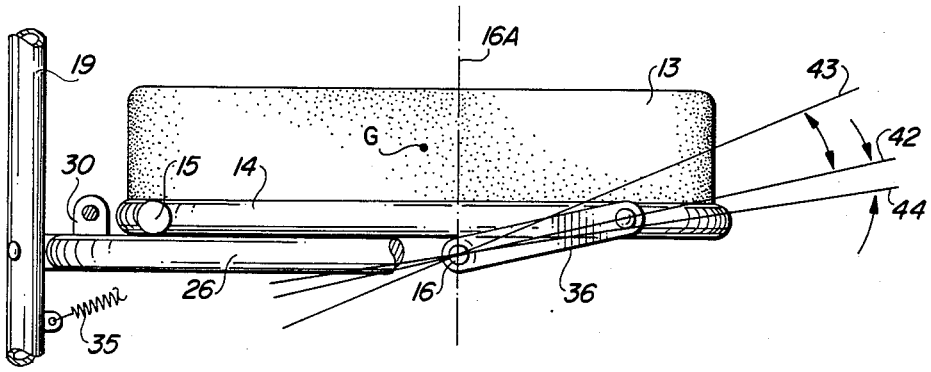
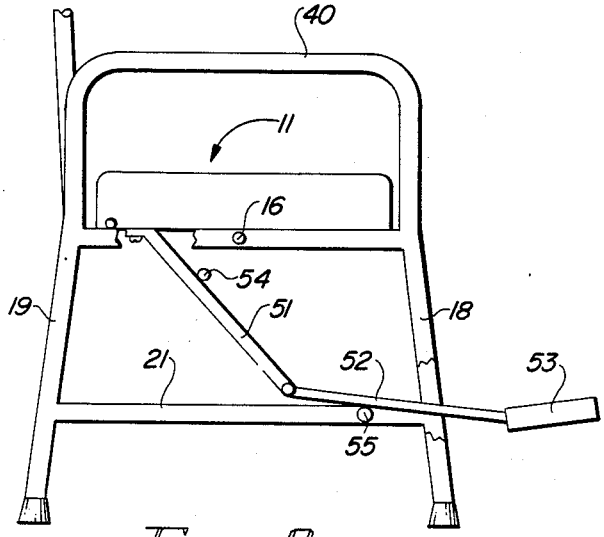
FIG. 8
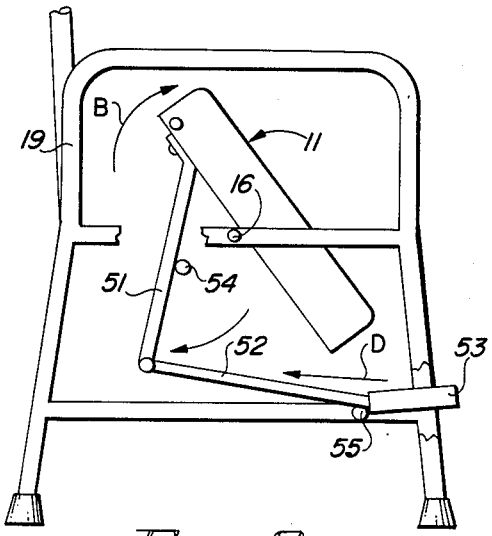
FIG. 9

ORTHOPEDIC CHAIR

This invention relates to orthopedic furniture.

More particularly, the invention relates to an orthopedic chair which minimizes the stress on the back when an individual moves from an upright position to a seated position.

In another respect, the invention relates to an orthopedic chair which continuously supports the upper legs and buttocks of an individual while the individual moves from an upright position to a seated position.

In a further respect, the invention relates to an orthopedic chair which enables a person to assume a seated position in a safe and controlled manner without requiring that the individual make use of his or her arms.

Chairs designed for use by handicapped individuals are well known in the art. See, for example, U.S. Pat. No. 4,538,853 to Levenberg. Such prior art charis typically incorporate hydraulic pistons or other mechanical apparatus which must be activated by the user to reposition the seat of the chair to facilitate a person's rising from a seated to an upright position. Further, such chairs are not particularly useful in assisting movement of a person from a standing to a sitting position because a person's knees must, before the person's buttocks contact and are support by the chair, be substantially bent such that the thighs are nearly at right angles to the calves of the legs. This means that unless an individual grasps the arm rests of the chair, the person cannot readily control movement from the upright to the seated position, and consqeuently, the buttocks of the person, unless the person bends forward at the waist, tend to "fall" under the force of gravity onto the seat of the chair. Bending forward at the waist or "falling" into the chair stresses the lower back. The afore-mentioned problems are particularly noticeable to a physically handicapped individual who has little or no use of his hands or arms, as can be the case if the individual is suffering from a severe case of rheumatoid arthritis.

Accordingly, it would be highly desirable to provide an improved orthopedic chair which would not require hydraulic pistons or other electrically actuated devices, would, without requiring the use of the individual's hands, permit an individual to provide support for his back while his body moves from an upright to a seated position, and would permit the individual to control the rate at which his body moves from an upright to a seated position.

Therefore, it is a principal object of the instant invention to provide an improved orthopedic chair.

In a further respect, it is an object of the invention to provide an improved chair which enables a person to move from an upright to a seated position, and vice-versa, in a gradual controlled motion.

In another respect, it is an object of the invention to provide an improved orthopedic chair which enables a person to move from an upright to a seated position without requiring use of the individual's hands and arms on chair armrests to control the rate of descent of the individual.

In still a further respect, it is an object of the instant invention to provide an improved orthopedic chair which, in operation, does not require the use of electrically or hydraulically operated devices.

In yet another respect, it is an object of the instant invention to provide an improved orthopedic chair which utilizes the force of gravity and weight of an individual balanced about a fulcrum to control the rate of descent of an individual from a standing to a seated position.

These and other, further and more specific objects and advantages of the invention will be apparent to those skilled in the art from the following detailed description thereof, taken in conjunction with the drawings, in which:

FIG. 5 is a side view of the seat means and fulcrum of FIG. 1 illustrating the mode of operation thereof;

FIG. 6 is a bottom view of the seat means and fulcrum of FIG. 5 further illustrating the mode of operation thereof;

FIG. 7 is a bottom view of the seat means of FIG. 5;

FIG. 8 is a side view ilustrating footrest-linkage means which can be utilized on the orthopedic chair of FIG. 1; and, FIG. 9 is a side view of the footrest-linkage means of FIG. 8 illustrating the mode of operation thereof.

Figure 1:
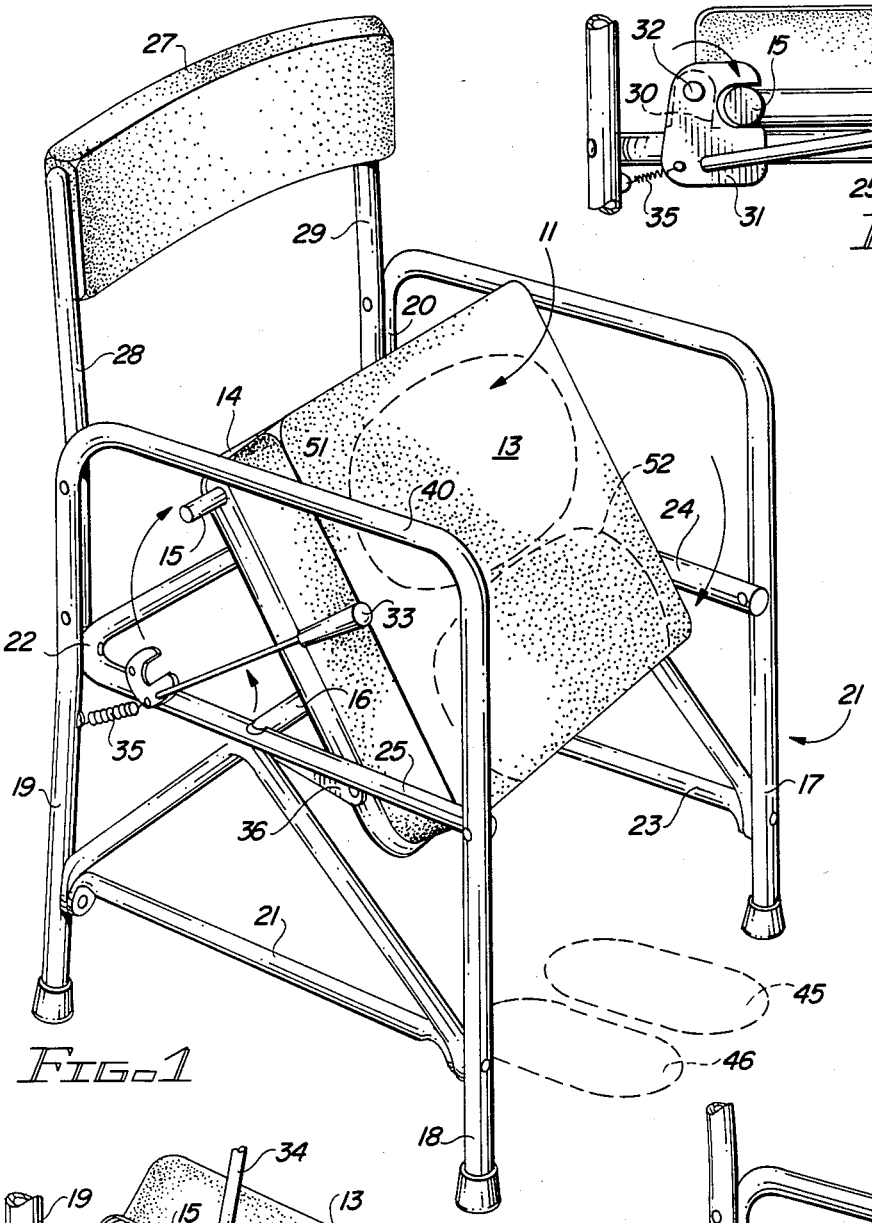
FIG. 1 is a perspective view illustrating an orthopedic chair constructed in accordance with the principles of the invention.

Briefly, in accordance with my invention, I provide an improved orthopedic chair. The chair includes seat means having a center of gravity; and, means to pivotally support the seat means above the ground. The support means includes an elongate horizontally disposed fulcrum positioned beneath the seat means and a fulcrum positioned beneath the seat means and a distance above the ground; and, means for maintaining the seat means in pivoting contact with the fulcrum for movement between at least two operative positions, a first operative position with said seat means in an upward orientation with said center of gravity of said seat means forward of said fulcrum such that the buttocks and legs of an individual contact said seat means in said first operative position after the individual stands adjacent said seat means forward of said fulcrum and beings to move from an upright to a seated position, and a second operative position with said seat means in a generally horizontal orientation such that the heels of the feet of the individual are normally above the ground when said individual is sitting on said seat means in said second operative position. The buttocks and upper legs of the individual generally remain in contact with the seat means during movement of the individual from an upright position to a seated position and of said seat means from the first to the second operative position.

Turning now to the drawings, which depict the presently preferred embodiments and best mode of the invention for the purpose of illustrating the practice thereof and not by way of limitation of the scope of the invention and in which like reference characters represent corresponding elements throughout the several views, FIGS. 1 to 9 illustrate an orthpedic chair constructed in accordance with the principles of the invention and including seat means 11 and means 12 to support seat means 11 above the ground. Seat means 11 includes cushion 13 mounted on rectangular tubular frame 14. Cylindrical foot 15 is attached to and extends outwardly from frame 14. Support means 12 includes cylindrical horizontally disposed fulcrum 16 maintained a distance above the ground by a tubular framework including vertically oriented legs 17–20 and horizontal members 21–25 interconnecting and bracing legs 17–20. Fulcrum 16 can be supported by structural members extending from a wall, ceiling, etc. Back 27 is connected to legs 19 and 20 by support members 28 and 29. U-shaped latch member 31 is piovtally secured by pin 32 to upstanding member 30 connected to member 25. Handle 33 is connected to arm 34. Arm 34 is fixedly attached to member 31. The ends of spring 35 are connected to leg 19 and latch member 31. Spring 35 continuously biases arm 34 in the position illustrated in FIG. 3. Link 36 is pivotally attached at one end to frame 14 and at its other end to fulcrum 16. Link 36 maintains seat means 11 in pivoting contact with fulcrum 16 for movement between at least two operative positions, a first operative position illustrated in FIGS. 1 and 5, and a second operative position illustrated in FIGS. 2, 3 and 6. U-shaped brackets 38, 39 or other appropriate means can be used in place of or in combination with link 36 to maintain seat means 11 in pivoting contact with fulcrum 16. Brackets 38 and 39 and shown in dashed outline in FIGS. 5 and 7 and are attached to the bottom of cushion 13.

When seat means 13 is in the first operative position illustrated in FIG. 5, the geometric center and center of gravity are in the position indicated by point G. In FIG. 5, points to the right of vertical line 16A are forward of fulcrum 16 while points to the left of line 16A are rearward of fulcrum 16. In FIG. 5, point G is forward of fulcrum 16. Since most seat means are generally symmetrical in shape and density, the center of gravity and geometrical center of seat means 11 will normally coincide.

Figure 3:
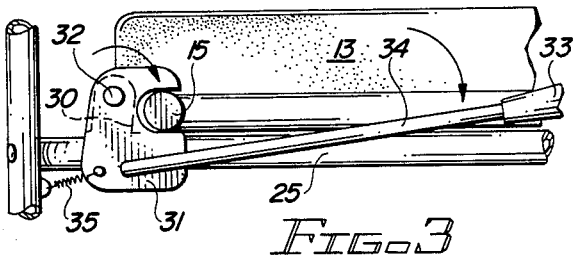
FIG. 3 is a side view of a portion of the chair of FIG. 1 illustrating the mode of operation of the seat means latching mechanism thereof.
Figure 4:
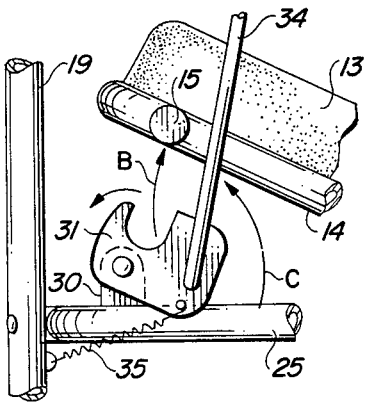
FIG. 4 is a side view of the seat means latching mechanism of FIG. 3 further illustrating the mode of operation thereof.
Figure 2:
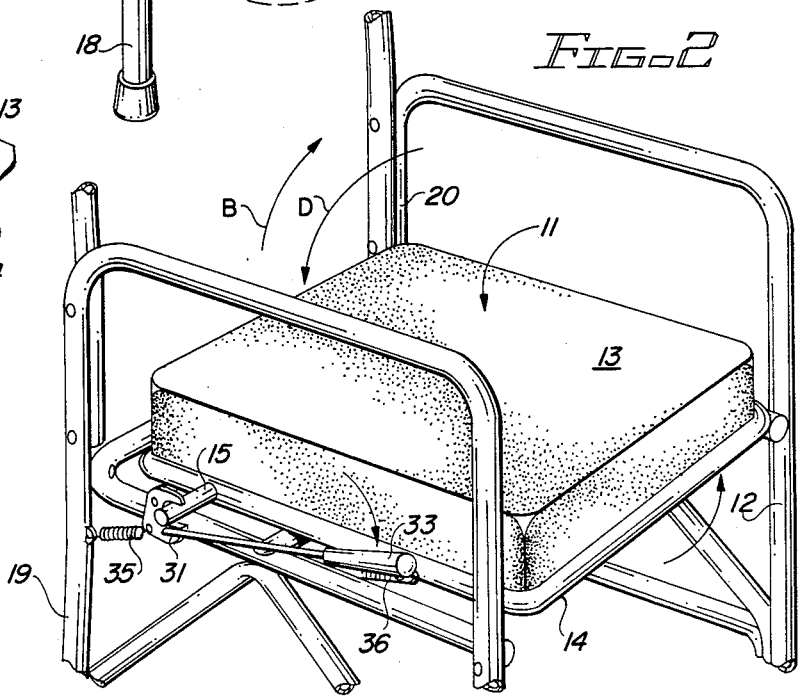
FIG. 2 is a perspective view of the seat means and a portion of the seat support means of the invention illustrating the mode of operation thereof.

The second operative position of seat means 11 is shown in FIGS. 2, 3 and 6. As indicated in FIG. 6, the geometrical and/or gravity centers are preferably located rearward of fulcrum 16 when seat means 11 is in the second operative position. While the center of gravity and geometrical centers are preferably rearward of fulcrum 16, they can, if desired, be over or forward of fulcrum 16 when seat means 11 is in the position of FIG. 6.

In FIG. 6, line 42 is the centerline or elongate axis of link 36. Link 36 can be shortened, and have a centerline 43, or can be lengthened, and have a centerline 44.

When seat means 11 is in the first operative position illustrated in FIG. 5, foot 15 bears upwardly against armrest 40, preventing the force of gravity from causing seat means 11 to continue to pivot about fulcrum 16 in the direction of arrow A. When seat means 11 is in the second operative position of FIGS. 2 and 3, latch member 31 normally engages foot 15 as illustrated in FIGS. 2 and 3, preventing seat means 11 from being upwardlly pivoted about fulcrum 16 in the direction indicated by arrow B in FIG. 2. Foot 15 is released from member 31 by pulling handle 34 upwardly in the direction of arrow C in the manner indicated in FIG. 4.

In use, the chair of the invention is positioned as shown in FIG. 1. The user stands adjacent seat means 11 forward of and facing away from fulcrum 16. The approximate position of the user's feet when he is standing adjacent seat means 11 is indicated by dashed lines 45 and 46 in FIG. 1. As the user begins to sit down, his buttocks and upper legs contact cushion 13 in the areas circumscribed by dashed lines 51 and 52, respectively, in FIG. 1. When the buttocks and upper legs of the user initially contact cushion 13, the legs of the user are normally slightly bent from the straight position the legs are in when the user is standing completely erect. After the user's buttocks and upper legs contact cushion 13 and the user continues to move downwardly from an upright position, the user can use the weight in his buttocks and legs to control movement of seat means 11 about fulcrum 16. Control of the movement of seat means 11 can be better understood by visualizing a model of a teeter-totter which is about six inches long. If a person places his hand on the teeter-totter palm down and centered over the fulcrum, he can readily control movement of the teeter-totter by using the fingertips or palm of the hand to apply small forces on the teeter-totter on either side of the fulcrum. When an individual contacts cushion 13 with his upper legs and buttocks, he can, in a manner similar to that just described for the small model of the teeter-totter, readily control movement of seat means 11 about fulcrum 16.

After an individual contacts seat means 11 in FIG. 1 with his upper legs and buttocks and continues to move from an upright to a seated position, he causes seat means 11 to pivot about fulcrum 16 in the direction of arrow D in FIG. 2 until foot 15 comes to rest in latch member 31 in the position illustrated in FIG. 3. Latch member 31 is shaped and dimensioned such that as foot 15 moves downwardly and contacts the top of member 31, member 31 is temporarily rearwardly displaced by the force of foot 15 against the top of member 31, permitting foot 15 to "snap" into member 31 in the position of FIG. 3.

In order for an individual seated in the chair of FIG. 2 to resume a standing position, he pulls handle 33 upwardly in the direction of arrow C to release foot 15 and, using the teeter-totter principle earlier described, increases the proportion of his body weight on the portion of cushion 13 forward of fulcrum 16 to cause seat means 11 to pivot upwardly about fulcrum 16 in the direction of travel indicated by arrow B in FIG. 2. By the time seat means 11 has upwardly pivoted to the position of FIG. 1, the user's feet are on the ground and the user is substantially upright, permitting the user to readily stand erect and walk away from the chair.

When a user is seated on cushion 13 with seat means 11 in the operative position illustrated in FIG. 2, the user's heels will normally dangle above the ground because the seat of the chair of the invention must be higher than is normally the case in order for the chair to properly function in the manner described. The footrest apparatus of FIGS. 8 and 9 can be utilized to support the feet of a user seated in the chair. The apparatus includes elongate member 51 and elongate member 52 pivotally attached at one end to member 51. A footrest 53 is fixedly attached to the other end of member 52. Horizontal rod 54 is fixedly mounted in the chair frame. When seat means 11 is upwardly displaced in the direction of arrow B (FIG. 9), member 51 is slidably drawn past and pivots around rod 54 to draw member 52 and footrest 53 in the direction of arrow D and permit a user's feet to drop to the ground when seat means 11 is raised in the direction of arrow B. Member 52 is slidably supported by horizontal rod 55. Rod 55 is fixedly mounted in the chair frame.

Having described my invention in such terms as enable those skilled in the art to understand and practice it and having identified the presently preferred embodiments and best mode thereof, I claim:

1. An orthopedic chair including (a) a frame including an elongate horizontally disposed fulcrum in fixed position at a distance above the ground;

(b) a seat resting on said fulcrum and having (i) a center of gravity, (ii) a geometrical center, and (iii) a base, said base of said seat resting on and supported by said fulcrum;

(c) linkage means extending from said fulcrum to said base of said seat and pivotally attached to said fulcrum and said base, said base pivoting over said fulcrum between at least two operative positions, (i) a first operative position with said seat in an upright orientation with at least one of said geometrical center and said center of gravity forward of said fulcrum such that the buttocks and upper legs of an erect individual contact said seat means in said first operative position after the individual stands adjacent said seat means and forward of said fulcrum to begin to move from an erect to a seated position, and (ii) a second operative position with said seat in a generally horizontal orientation resting on said fixed fulcrum and with the individual seated in said chair, the individual controlling with his buttocks and upper legs the movement of said seat from said first to said second operative position, said chair being shaped and dimensioned such that the heels of the feet of an individual are above the ground when the individual is sitting on said seat in said second operative position.

2. An orthopedic chair including (a) a frame including a back support, arm rests and an elongate horizontally disposed fulcrum in fixed position at a distance above the ground;

(b) a seat resting on said fulcrum and having (i) a center of gravity, (ii) a geometrical center, and (iii) a base, said base of said seat resting on and supported by said fulcrum;

(c) an elongate link extending from said fulcrum to said base of said seat and pivotally attached to said fulcrum and said base, said seat pivoting over said fulcrum independently of said back support and arm rests between at least two operative positions, said link connecting said seat to said frame and pivoting about said fulcrum with said base, (i) a first operative position with said seat in an upright orientation with at least one of said geometrical center and said center of gravity forward of said fulcrum such that the buttocks and upper legs of an erect individual contact said seat means in said first operative position after the individual stands adjacent said seat means and forward of said fulcrum to begin to move from an erect to a seated position, and (ii) a second operative position with said seat in a generally horizontal orientation resting on said fixed fulcrum and with the individual seated in said chair, said chair being shaped and dimensioned such that the heels of the feet of an individual are above the ground when the individual is sitting on said seat in said second operative position.

* * * * *